US005404619A

United States Patent [19]

Jorg

[11] Patent Number: 5,404,619

[45] Date of Patent: Apr. 11, 1995

[54] COMBING MACHINE WITH NOIL MEASURING

[75] Inventor: Andreas Jorg, Neftenbach, Switzerland

[73] Assignee: Maschinenfabrik Rieter AG, Winterthur, Switzerland

[21] Appl. No.: 98,347

[22] PCT Filed: Dec. 8, 1992

[86] PCT No.: PCT/CH92/00238

§ 371 Date: Oct. 1, 1993

§ 102(e) Date: Oct. 1, 1993

[87] PCT Pub. No.: WO93/12277

PCT Pub. Date: Jun. 24, 1993

[30] Foreign Application Priority Data

Dec. 9, 1991 [CH] Switzerland ..... 03614/91

[51] Int. Cl.[6] ..... D01G 19/22

[52] U.S. Cl. ..... 19/115 B

[58] Field of Search ..... 19/90, 105, 115 A, 115 R, 19/115 B, 203, 205, 107; 57/265, 264

[56] References Cited

U.S. PATENT DOCUMENTS

| | | | |
|---|---|---|---|
| 787,139 | 4/1905 | Wenning et al. | 19/115 B |
| 905,233 | 2/1908 | Rota | 19/115 B |
| 1,613,672 | 1/1927 | Grady | 19/115 B |
| 3,612,616 | 4/1969 | Stewart | 19/107 |
| 4,736,493 | 4/1988 | Hass-Zöllick et al. | 19/205 X |
| 4,815,170 | 3/1989 | Estruch Porteil | 19/107 X |
| 4,987,648 | 1/1991 | Clement | 19/115 R |
| 5,161,111 | 11/1992 | Oehler et al. | 364/470 |
| 5,287,597 | 2/1994 | Mondini et al. | 19/115 B |

FOREIGN PATENT DOCUMENTS

| | | | |
|---|---|---|---|
| 0339300 | 11/1989 | European Pat. Off. . | |
| 0410429 | 1/1991 | European Pat. Off. . | |
| 1815921 | 7/1969 | Germany . | |
| 0232766 | 2/1986 | Germany | 19/115 R |
| 4113384 | 11/1991 | Germany . | |
| 1244310 | 8/1971 | United Kingdom . | |
| 1506083 | 4/1978 | United Kingdom . | |

OTHER PUBLICATIONS

Swiss Patent Application Ch 1841/91; Aug. 1992.

International Application PCT/CH91/00140, Jan. 9, 1992.

International Application PCT/CH92/00236, Jun. 24, 1993.

International Application No. PCT/CH92/00238, Jun. 24, 1993.

*Primary Examiner*—Clifford D. Crowder

*Assistant Examiner*—Ismael Izaguirre

*Attorney, Agent, or Firm*—Sandler, Greenblum & Bernstein

[57] ABSTRACT

Combing machine. The combing machine comprises a plurality of combing heads, with every combing head including an apparatus for supplying one lap each to be combed, a device for combing out noils, and a device for detaching combed fiber tufts from the lap and for forming a single head sliver, the combing machine further including a guiding device for pneumatically carrying off the removed noils and a device for the automatic continuous or periodic generation of a signal representative of the noils or comber waste share while the machine is in operation, with the generating device comprising a measuring apparatus for determining the comber waste quantity carried off per time unit and/or a device for supplying a signal representative of the combed material quantity formed per time unit and/or a device for determining the lap quantity supplied per time unit, it being possible, with the noted signal, if required, to change the settings of the combing machine and/or the machine disposed ahead of the combing machine.

9 Claims, 3 Drawing Sheets

COMBING MACHINE WITH NOIL MEASURING

CROSS REFERENCE TO RELATED APPLICATIONS

This application claims the priorities of both PCT Application No. PCT/CH92/00238, filed Dec. 8, 1992, and Swiss Application No. 03 614/91-9, filed Dec. 9, 1991.

BACKGROUND OF THE INVENTION

1. Field of the Invention

The invention relates to a combing machine having a plurality of combing heads, with every combing head including an apparatus for feeding one lap each to be combed, a device for combing out noils and a device for detaching combed fibre tufts from the laps and for forming a single head silver, and a guiding device for pneumatically carrying off the removed noils.

In such combing machines tile so-called comber waste or noils share is often determined. The terms comber waste share or comber waste percentage mean, for example, the ratio as expressed in per cent between the mass of the discharged comber waste and the mass of the supplied laps. Comber waste is the short fibres and some impurities removed from the fibrous material by the process of combing. On the basis of the determined comber waste share it is possible, if necessary, to correct certain settings in the combing machine itself or the machines which produce the laps to be supplied to the combing machine from the raw fibrous material.

2. Discussion of the Background of the Invention and Material Information

In known combing machines the machine is turned off for determining the comber waste share and the combing machine sliver, which is formed by single head slivers that are joined after a drafting arrangement, is detached (torn off). Thereafter a mesh flap is swivelled to the closed position in the guiding means which are used for the pneumatic discharge of the comber waste or a comber waste collection container is inserted. Thereafter the combing machine is put back into operation for a short period, e.g. 10 secs. Then the combing machine sliver is detached again and the detached combing machine sliver and the comber waste stored in the mesh flap or in the collection container are weighed and their ratio is compared with one another. This process is repeated two to three times and thereafter a mean value is established.

It is the object of the present invention to prevent the interruption of the operation and to avoid the considerable work and time which are required in known combing machines for determining the comber waste share.

SUMMARY OF THE INVENTION

This object is achieved in a combing machine having a plurality of combing heads, with every combing head including an apparatus for feeding one lap each to be combed, a device for combing out noils and a device for detaching combed fibre tufts from the laps and for forming a single head silver, a guiding device for pneumatically carrying off the removed noils; and a device for continuous or periodic generation of a signal representative of the comber waste share while the combing machine is in operation.

A display can be controlled with the signal representative of the comber waste share, on the basis of which the operating staff can decide when a setting in the combing machine and/or in one or several of the machines situated previously have to be changed. If desired, the signal can also control such changes directly automatically. Moreover, the signal can also be used to produce a shift log on the comber waste share in the combing machine automatically during a work shift.

The value of the signal representative of comber waste share A can be calculated in the device for producing said signal on the basis of two of the three values W=mass of the laps supplied per time unit, Z=mass of the single head slivers formed per time unit and K=mass of the comber waste carried off per time unit. As $Z=W-K$, this leads to $A=K/W=(W-Z)/W=K/(Z+K)$. The said device preferably contains a measuring apparatus for determining the mass K of the comber waste carried off per time unit. In addition, the device may comprise means for supplying a signal representative of the mass of the single head slivers formed per time unit or, instead, means for measuring the mass W of the laps supplied per time unit. Mass W does not necessarily have to be measured: One could also preset a constant (adjustable) value for the mass W in the device or the device could contain means for calculating the mass W from the known weight of the supplied laps per length unit and the length of the laps supplied per time unit. Said length depends on the number of nips of the comb per time unit and the lap feed quantity per nip of the comb. One could therefore supply signals for the calculation of mass W to the said device, for example, which is representative of the number of nips of the comb per time unit and the feed quantity set in the combing machine.

If said device measures or is preset with the mass W of the laps supplied per time unit and if it additionally comprises means for supplying a signal representative of the mass Z of the single head slivers formed per time unit, then it is not necessary to measure mass K of the comber waste carried off per time unit because comber waste share A can also be calculated from W and Z, as was mentioned above:

$$A=(W-Z)/W$$

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
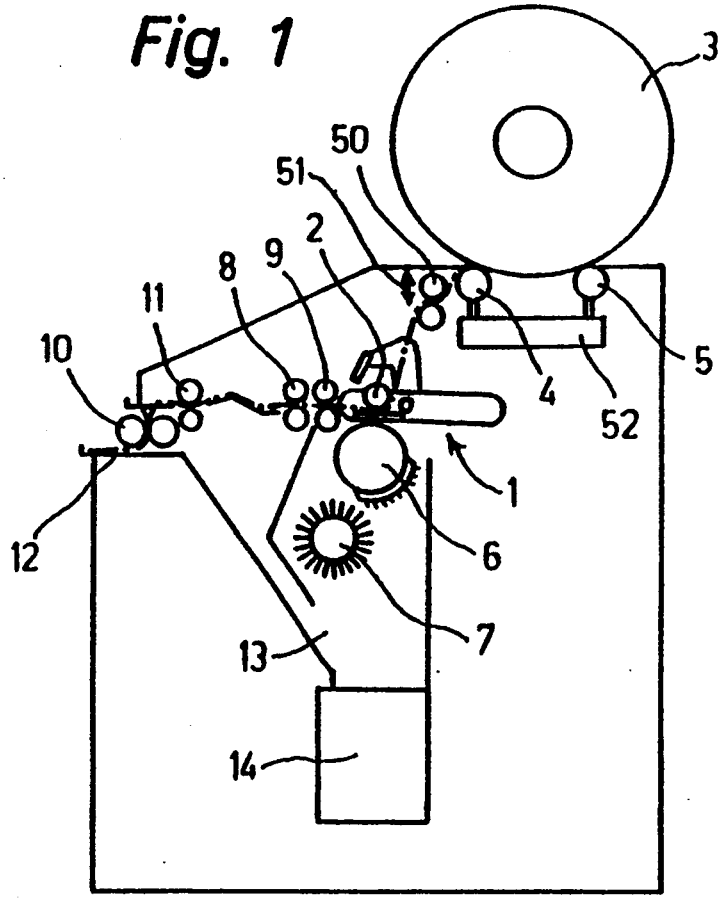
FIG. 1 shows a schematic vertical section through a combing machine in the zone of a combing head thereof.

In accordance with FIG. 1 a combing head of a combing machine comprises a pivoting nipper 1, in which an intermittently rotatable feed roller 2 is held. The feed roller 2 is supplied with a lap to be combed from the scutcher lap 3 which is held on two rotatable lap rollers 4 and 5. In a retracted position of nipper 1 a fibre tuft of the supplied lap is nipped between the nipper plates of the nipper arrangement and is combed out by a rotating round comb 6 which cooperates with an also rotating round comb brush 7. The nipper arrangement 1 is then moved to its advanced end position as shown herein and opened, and the fibre tuft is detached from the lap by a detaching arrangement comprising pairs of rollers 8 and 9 and joined with the fleece made from combed material which was produced beforehand.

The combed single head sliver then passes through pairs of draw-off rollers 10 and 11 and is supplied by these in form of a sliver or fleece to a delivery table 12, which is jointly used by all combing heads of the machine.

The short fibres, neps and impurities removed from the fibrous material by the round comb 6 and a top comb (not shown) are sucked off as the so-called comber waste or noils through a guiding duct 13 to a suction duct 14, which is jointly allocated to all combing heads of the machine.

Figure 2:
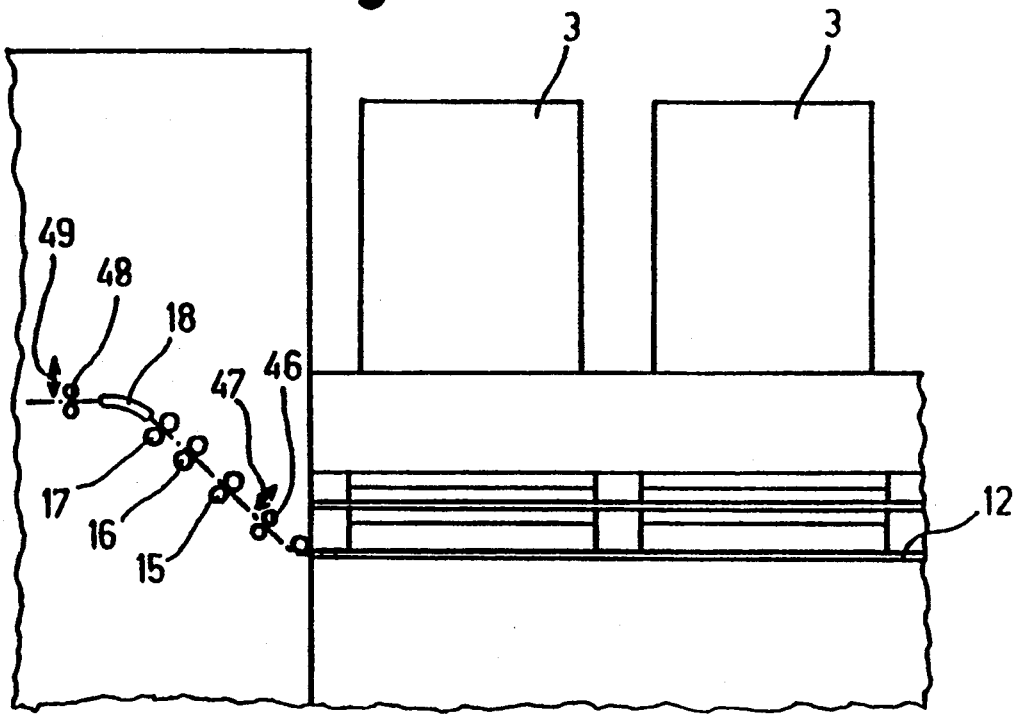
FIG. 2 shows a schematic front view (as seen from the left in FIG. 1) of a part of the combing machine.

The single head slivers from the Various combing heads of the machine run on the delivery table 12, usually adjacent to one another, to a common drafting arrangement, of which FIG. 2 schematically shows three pairs of rollers 15, 16 and 17. At the exit of the drafting arrangement 15, 16, 17 a trumpet 18 is arranged which transforms the drawing-frame sliver into a combing machine sliver, which is then deposited in a can (not shown).

A combing machine of the type as mentioned above comprises, in accordance with the invention, a device for continuous or periodic generation of a signal representative of the comber waste share. The comber waste share A is the ratio between the mass K of the comber waste carried off per time unit through the suction duct 14 of the machine and the mass W of the laps supplied per time unit to the combing heads of the machine, $A=K/W$.

Figure 3:
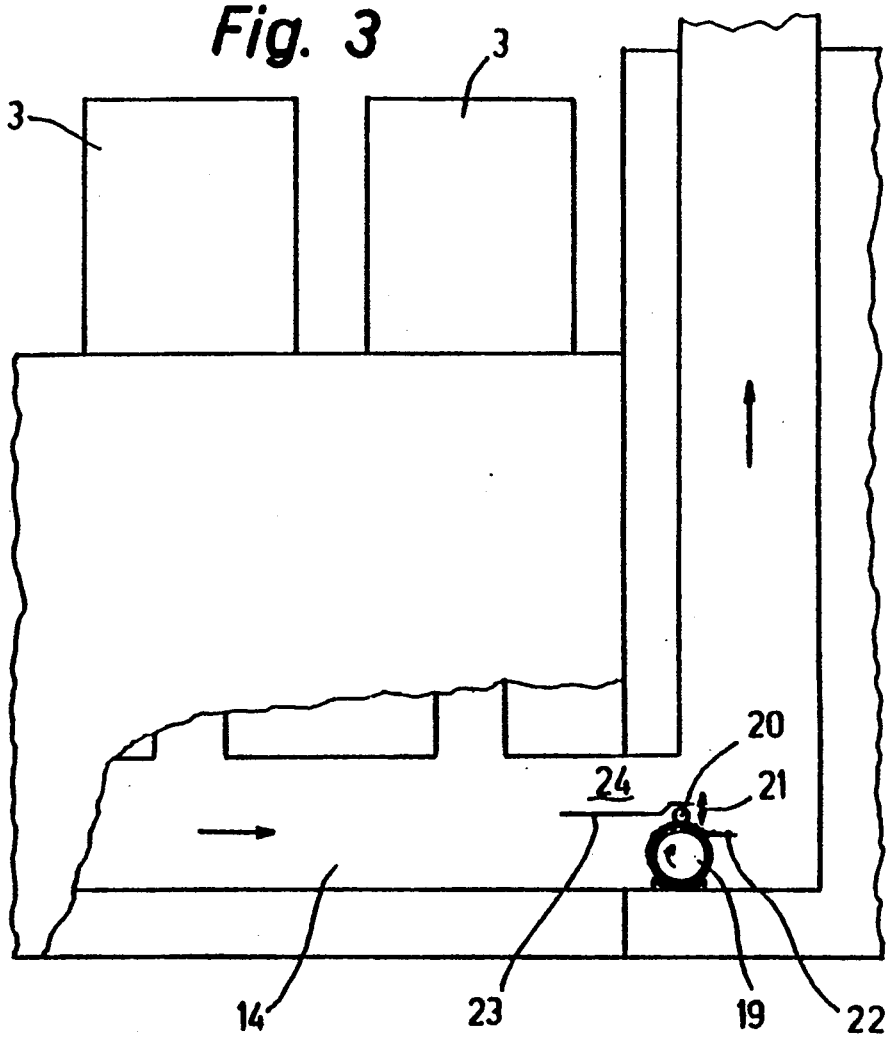
FIG. 3 shows a schematic rear view of the part of the combing machine as shown in FIG. 2 and FIGS. 4 to 7 each show different embodiments of the measuring apparatus determining the comber waste quantity carried off per time unit, with each Fig. being shown in a view according to a section of FIG. 3.

The said device preferably contains a measuring apparatus for determining the comber waste quantity carried off per time unit. Said measuring apparatus may comprise, for example, a movable screen surface disposed in the stream of the comber waste pneumatically carried off through the suction duct 14. Comber waste deposits on the screen surface. The thickness of the deposited comber waste layer can then be measured before the layer is stripped off from the screen surface. The thickness of the comber waste layer forms a value for the comber waste quantity transported per time unit through suction duct 14. As is schematically shown in FIG. 3, for example, a rotatable screening drum 19 is arranged in suction duct 14. The comber waste layer deposits on the front side of screening drum 19 showing towards the suction air stream. A sensor roller 20, which is movably held in the direction of double arrow 21, rests on the comber waste layer. A locator (not shown) is coupled with the bearings of sensor roller 20, which locator issues a signal representative of the thickness of the comber waste layer. This signal can be directly used as a measure for the quantity K of the comber waste carried off per time unit through the suction duct 14. The signal of the locator, for example, can also be supplied to an automatic controller which sets the speed of screening drum 19 in such a way that the thickness of the comber waste layer remains at a preset value. In this case the corrective signal issued by the automatic controller can be used as a value for comber waste quantity K. After the passage under sensor roller 20, the comber waste layer is removed again from the surface of screening drum 19 by a stripper element 22.

A screening drum, however, can also be arranged in such a way that comber waste may collect on its circumference also during more than one rotation. For this purpose a pressure below atmospheric is maintained in the interior of the screening drum and the stripper element 22 is dropped or moved away from the screening drum. The locator of the sensor roller resting on the comber waste layer then issues a signal as a value of the comber waste quantity K carried off per time unit which is representative of the speed of the thickness increase of the comber waste layer. It is also possible to replace the locator by a stop switch which is responsive whenever the thickness of the comber waste layer has reached a predefined value. In this case the length of the time which has passed until the response of the stop switch is a value for the comber waste quantity K carried off per time unit. (The length of the time interval is inversely proportional to the comber waste quantity per time unit). It is obvious that the screening drum has to be emptied periodically, e.g. in any case after the response of the said stop switch. For emptying the screening drum it may be possible to either remove the pressure below atmospheric in its interior and/or move stripping elements towards the circumference of the drum.

The thickness of the comber Waste layer on the screening drum 19 could also be determined optically instead of mechanically by using sensor roller 20 and the locator or stop switch coupled therewith. For example, one or several light sources could be disposed in the interior of the screening drum 19, which drum may be composed of a transparent material such as glass. Outside of the drum one or several light receivers could be arranged, whose output signals are representative of the weakness of the light from the light source or light sources depending on the thickness of the comber waste layer. The light source(s) and the light receiver could both be arranged outside of the screening drum 19 in such a way that the light receivers determine the reflection of the light from the light sources depending on the thickness of the comber waste layer.

FIG. 3 also shows that screening drum 19 does not extend over the whole cross section of suction duct 14, but only over a part of the height of the suction duct up to a flow dividing plate 23. In this way a by-pass duct 24 is formed which receives a part of the air stream and the comber waste transported therein. The by-pass duct is usually necessary so as to provide in the suction duct 14 in front of the screening drum 19 a sufficiently high pressure below atmospheric for the suction of the comber waste from-the combing heads of the comber machine. Due to the by-pass duct it is obvious that only a part of the comber waste can deposit on the circumference of the screening drum 19, e.g. approx. half thereof. If is sufficient, however, if the mass of this share in the comber waste is measured as described above. From the measured mass it is possible to determine with sufficient preciseness the overall mass of the comber waste by multiplication with a constant factor.

Figure 4:
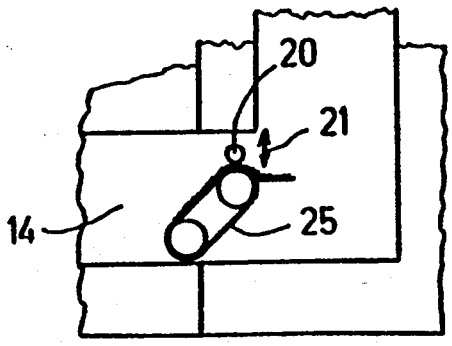

Instead of the rotating screening drum 19 it is naturally also possible to use another, continuously or intermittently moved screening surface with the same effect, e.g. a revolving screening belt 25, as is shown in FIG. 4. The by-pass duct 24 has been deleted in FIG. 4, but it obviously could also be provided.

Figure 5:
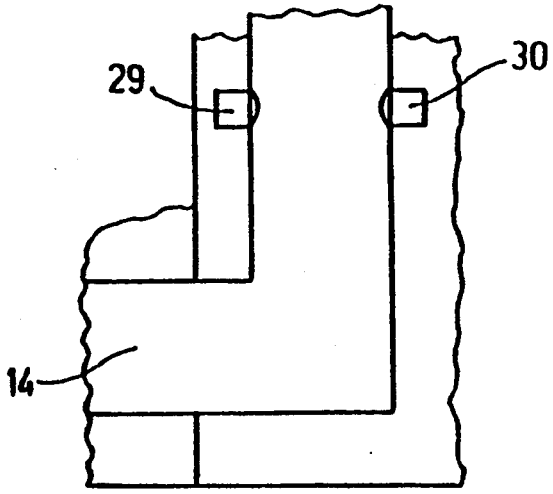

FIG. 5 schematically shows a further embodiment of a measuring apparatus for determining the comber waste quantity carried off per time unit through suction duct 14. The measuring apparatus comprises one or several radiation sources, e.g. light sources, which are arranged on one side of the suction duct 14 and one or preferably several radiation receivers 30, e.g. light receivers, which are arranged on the side of the suction duct 14 opposite of the radiation sources 29. The radiation sources 29 and the radiation receivers 30 form a light barrier. The comber waste conveyed through the suction duct 14 cause a weakening of the radiation impinging on the radiation receivers 30, and the radiation receivers emit a signal which is proportional to mass K of the comber waste carried off from the combing machine per time unit through the suction duct 14.

Figure 6:
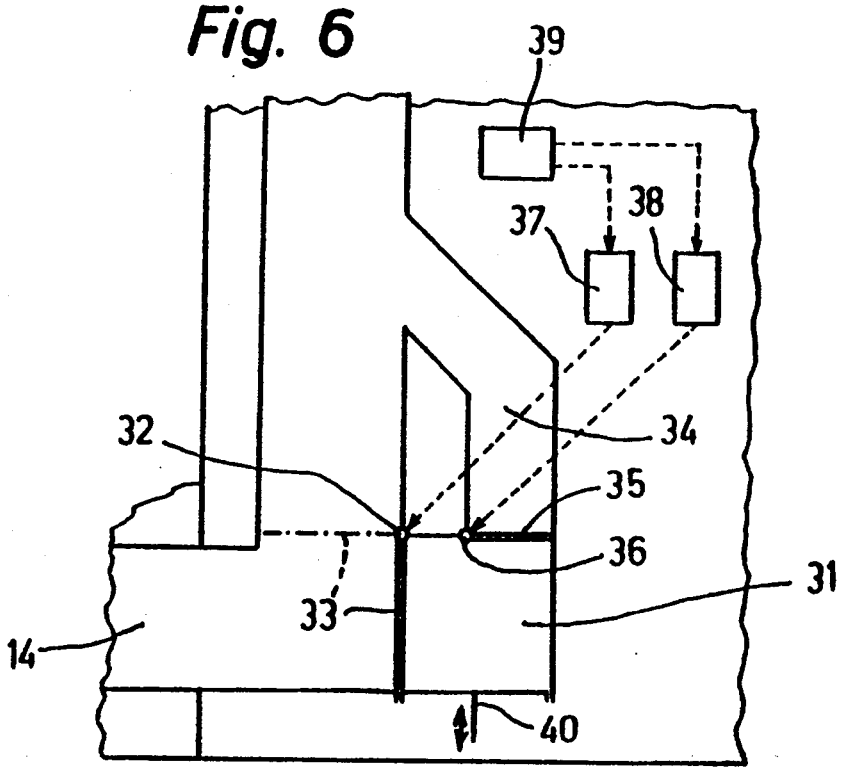

FIG. 6 schematically shows a further embodiment of a measuring apparatus for the automatic determination of the comber waste quantity carried off per time unit through the suction duct 14. In addition to the suction duct 14 there is a chamber 31 which is separated from the suction duct by a flap 33 swivellable about an axle 32. An outlet duct 34 starts out from chamber 31, which duct opens out in the direction of flow beyond flap 33 in suction duct 14. At the entrance of outlet duct 34 there is a screening plate 35 which is swivellable about an axle 36. Screening plate 35 is usually in the opened position (not shown). Drive means 37 or 38 for flap 33 and screening plate 35 are controlled by a control device 39 with a timer. The control device 39 controls drive 37 periodically in such a way that said control device swivels flap 33 to its position as is shown in the dot-dash line. Suction duct 14 is then interrupted and its part coming from the combing heads is connected with chamber 31. The air stream with the comber waste therefore passes through chamber 31 and, when screen plate 35 is opened, passes through outlet duct 34. The air stream also carries off comber waste which has remained in chamber 31. Thereafter the control unit controls drive 38 in such a way that it swivels screening plate 35 to its closed position as is shown in the drawing, so that the comber waste supplied by the air stream is now retained by the screening plate 35. After a predefined period of time flap 33 is swivelled back to its position shown in the unbroken line and closes the entrance side of chamber 31. Now the comber waste quantity is determined which has accumulated within the predefined period, of time in chamber 31. The comber waste quantity is measured, for example, by means of a weighing machine 40 forming the floor of chamber 31. Instead, it would also be possible to measure the volume of the accumulated comber waste, e.g. with an optical device. The weighing machine 40 or the optical device emit a signal which is representative of the comber waste quantity K carried off from the combing machine per time unit. The screen plate 35 can be opened again thereafter, so that the comber waste can be removed from chamber 31 as described above when flap 33 is swivelled again.

In the present description it has been assumed that the suction duct 14 conveying the comber waste extends from the combing machine to a suction device jointly allocated to several machines. In contrast to this a drum separator is provided in the suction duct itself in accordance with FIG. 7, which separator belongs to the combing machine. The drum separator is provided with a rotatable screening drum 41, from whose inner space a suction opening or a suction duct 42 starts out. A suction blower (not shown) is connected thereto. The comber waste delivered with the air stream through suction duct 14 deposits on the circumference of screening drum 41 in form of a layer or a fleece. The circumference is in contact with a rotatable fleece detaching roller 43. Adjacent to the fleece detaching roller 43 and to the circumference of screening drum 41 there is a fleece compaction roller 44 which is movably held in the direction of arrow 45 and which presses the comber waste fleece with a predefined pressure against screening drum 41 and the fleece detaching roller 43. A locator (not shown) is coupled with the bearings of roller 44 which emits a signal representative of the thickness of the comber waste fleece. This signal can be used directly as a value for the quantity K of the comber waste carried off per time unit through the suction duct 14 or, as was already described above in connection with FIG. 3, also as a control signal according to which an automatic controller sets the speed of the screening drum 41.

However, it is also possible to form a sliver from the comber waste fleece detached from the screening drum 41 and to measure the mass of the sliver formed per time unit, for example by scanning the thickness of the sliver or by weighing the sliver formed within a specific time unit. The mass of the sliver thus formed per time unit is obviously equivalent to the mass K of the comber waste carried off per time unit through suction duct 14.

The device for automatic generation of a signal representative of the comber waste share may comprise further means which supply a signal representative of the combed material quantity Z formed per time in the combing heads. These means may be arranged in such a way, for example, that the thickness of the single head slivers coming from the combing heads and jointly travelling towards the drafting arrangement 15, 16, 17 (FIG. 2) is measured, e.g. by means of a sensor roller 46 which rests on the single head slivers. The sensor roller 46 is movable in the direction of arrow 47, whereby its bearings are coupled with a locator (not shown) which emits a signal proportional to the quantity Z of the single head slivers formed per time unit. Instead, the means for supplying such a signal could comprise a sensor roller 48 which measures the thickness of the combing machine sliver exiting from trumpet 18 after drafting arrangement 15, 16, 17. The bearings of sensor roller 48 movable in the direction of arrow 49 would then be coupled with a locator (not shown) which emits the said signal.

Furthermore, the device for generating the signal representative of the comber waste shape may also comprise means for measuring the lap quantity W which is supplied to the combing heads of the combing machine per time unit. These means could, for example, measure the thickness of the laps which are supplied to nippers 1 of the combing heads, e.g., by means of sensor rollers 50 (FIG. 1) which rest on the laps. The locators (not shown), which are coupled with the bearings of sensor rollers 50 movable in the direction of arrow 51, then emit signals which are proportional to the lap quantities which are supplied to each combing head per time unit.

The above-mentioned sensor rollers each measure the material thickness. The material quantity per time unit is naturally proportional to the measured material thickness, to the width of the material (which can usually be assumed as being constant) and to the movement speed of the material.

The means for measuring the lap quantities supplied per time unit could also directly measure the lap quantities per time unit instead of the lap thickness. For example, the bearings of lap rollers 4 and 5, which carry the Scutcher lap 3 in every combing head, can be carried by a weighing machine 52 which emits a signal representative of the weight loss of the scutcher lap 3 per time unit.

The device for generating the signal representative of the comber waste share further comprises a computer (not shown). It calculates the comber waste share $A=K/W$ from two of the three values $W$=mass of the laps supplied per time unit, $Z$=mass of the combed material formed per time unit and $K$=mass of the comber waste carried off per time unit. Mass W of the laps supplied per time unit can be received by the computer, as explained above, from weighing machines 52 or from the thicknesses of the laps as measured by sensor rollers 49 and the delivery speed of the laps. The delivery speed is equivalent to the product of the number of nips of the comb and the feed rate. The number of nips of the comb is the number of reciprocations of nipper 1 or the rotations of round comb 7 per time unit, e.g. approx. 300 per minute. The feed rate is the path by which the intermittently rotating feed cylinder 2 advances the lap during each reciprocating movement of nipper 1, e.g., approx. 6 mm. If one assumes a constant thickness or a constant weight per length unit of the laps, e.g. approx. 80 g per m, it is possible to supply the computer with a value W of the laps supplied per time unit which depends on the set number of nips and the set feed rate. In a combing machine with eight combing heads, a lap weight of 80 g per m, 300 nips of the comb per minute and a feed rate of 6 mm, $W=8.80$ g/m. 300 $min^{-1}$6 mm=approx. 1150 g per minute.

Mass Z of the combed material formed per time unit can be calculated by the computer from the thickness of the single head slivers and the conveying speed thereof as measured by the sensor roller 46 or the sensor roller 48.

Figure 7:
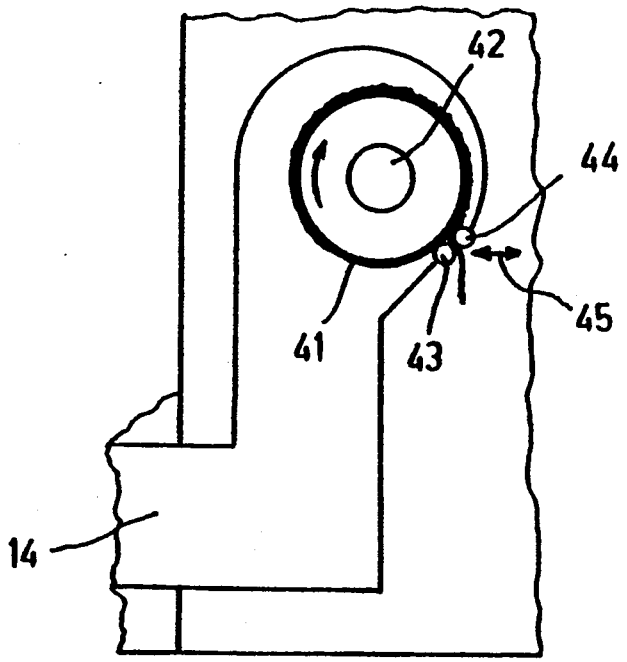

Mass K of the comber waste carried off per time unit through suction duct 14 can be calculated by the computer, for example, from the thickness of the comber waste layer as measured by sensor roller 20 (FIG. 3) and the speed of screening drum 19, or from the length of the time interval which passes until the comber waste layer on the screening drum has reached a predefined thickness, or from the signals as emitted by a measuring apparatus provided with radiation sources 29 and radiation receivers 30 pursuant to FIG. 5, or from the comber waste weight as determined in a weighing machine 40 in accordance with the embodiment of FIG. 6 and from the length of the time interval between the closure of the screening plate 35 and the closure of flap 33, or from the thickness of the comber waste layer as measured by the fleece compaction roller 44 in accordance with the embodiment of FIG. 7 and speed or circumferential speed of screening drum 41.

The signal generated continuously or periodically without interrupting the operation of the combing machine and representative of the comber waste share may control a display, on the basis of which the operating staff may decide when settings in the combing machine and/or machines disposed prior thereto, which produce from the raw fibrous material the laps supplied to the combing machine, should be changed. If desired, the signal may automatically control such changes directly. Settings in the combing machine which have an influence on the comber waste share are the detaching distance and the feed rate and the feed time, in particular. The feed rate is, as was mentioned above, the path over which the intermittently rotating feed cylinder advances the lap during every reciprocating movement of nippers 1. The feed time is the time at which said advancement takes place within every reciprocating movement of nippers 1. The detaching distance is the distance which the lower nipper plate of nipper arrangement 1 has in its advanced end position from the adjacent pair of detaching rollers 8 and 9.

The monitoring of the comber waste could also be made continuously or periodically directly on the individual combing heads of the combing machine.

In this way it is possible to obtain a signal on the operating modes of the individual combing heads and to thus carry out a supervision of the combing heads in comparison with the measured comber waste share of adjacent combing heads.

The addition of the individual signals of the combing machine of a machine leads to an overall signal which can be used for the overall process control.

The present invention is in connection with Swiss patent application CH 1841/91 of Jun. 21, 1991, where a signal is gained from a controlled drafting arrangement representative of the evenness of the feed material and representative of the respective performance of the previous machines, as well as in connection with the principles as set forth in the PCT application PCT/CH91/00140, whereby conclusions can be made on the performance of the previous machines through the short fibre share (comber waste) in connection with the feed material.

The invention is also-in connection with an own Swiss patent application, submitted on Dec. 9, 1991 under obj. 2276 or Swiss patent application CH 03/620/91-4 of Dec. 9, 1991, according to which conclusions can be drawn on the supplied fibrous material and on the material feed through a signal for the evenness of a formed combing machine sliver in comparison with a signal for the comber waste share.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A combing machine, with a plurality of combing heads, each one of said heads comprising means for feeding one lap each to be combed; means for combing out noils; means for detaching combed fibre tufts from the lap and for forming a single head sliver; guiding means for pneumatically carrying off the removed noils; a device for one of continuous and periodic automatic generation of a signal representative of the presence of the noils during the operation of the combing machine, said generation device comprising a measuring apparatus for determining the quantity of noils carried off per time unit, said measuring apparatus comprising a sensor element for determining the thickness of a layer of noils continuously supplied in an air supply stream, said layer accumulating on an upper surface of a screening unit located in said air supply stream.

2. The combing machine of claim 1, wherein the screening surface is one of continuously and intermittently movable.

3. The combing machine of claim 2, wherein the screening surface is the circumferential surface of a rotating drum of a drum separator and the sensor element is a movably held fleece compaction roller.

4. A combing machine, with a plurality of combing heads, each one of said heads comprising means for feeding one lap each to be combed; means for combing out noils; means for detaching combed fibre tufts from the lap and for forming a single head sliver; guiding means for pneumatically carrying off the removed noils; a device for one of continuous and periodic automatic generation of a signal representative of the presence of the noils during the operation of the combing machine, said generation device comprising a measuring apparatus for determining the quantity of noils carried off per time unit, said measuring apparatus comprising, within said guiding means, a chamber with an entrance side closable by means of a movable plate and a discharge side closable by means of a movable screening plate and a quantity measuring device for determining the quantity of noils contained in the closed chamber.

5. The combing machine of claim 4, wherein the quantity measuring device is a weighing machine.

6. The combing machine of claim 4, further including drive means for the plates, said plates being controlled by a timer in intervals and used for keeping open said movable plate and keeping closed said screening plate during a predefined period of time.

7. A combing machine, with a plurality of combing heads, each one of said heads comprising means for feeding one lap each to be combed; means for combing out noils; means for detaching combed fibre tufts from the lap and for forming a single head sliver; guiding means for pneumatically carrying off the removed noils; a device for one of continuous and periodic automatic generation of a signal representative of the presence of the noils during the operation of the combing machine, said generation device comprising means for measuring the lap quantity supplied per time unit.

8. The combing machine of claim 7, wherein the means for measuring the lap quantity comprise sensor elements for determining the thicknesses of the supplied laps.

9. The combing machine of claim 7, wherein the means for measuring the lap quantity comprise weighing devices for determining weight losses of scutcher laps from which the laps to be combed are withdrawn.

* * * * *